United States Patent [19]

Calandra, Jr.

[11] Patent Number: 4,861,197

[45] Date of Patent: Aug. 29, 1989

[54] ROOF BOLT SYSTEM

[75] Inventor: Frank Calandra, Jr., Pittsburgh, Pa.

[73] Assignee: Jennmar Corporation, Pittsburgh, Pa.

[21] Appl. No.: 62,729

[22] Filed: Jun. 15, 1987

[51] Int. Cl.[4] ..... E21D 20/00

[52] U.S. Cl. ..... 405/259; 411/44; 411/45

[58] Field of Search ..... 405/261, 260, 259; 52/738, 737, 740; 411/55, 57, 60, 64, 69, 72

[56] References Cited

U.S. PATENT DOCUMENTS

| | | | |
|---|---|---|---|
| 3,119,203 | 1/1964 | Finsterwalder . | |
| 3,292,337 | 12/1966 | Finsterwalder | 52/738 |
| 3,561,185 | 2/1971 | Finsterwalder et al. | 52/737 |
| 3,702,060 | 11/1972 | Cumming | 405/261 |
| 3,757,528 | 9/1973 | Finsterwalder et al. . | |
| 3,978,674 | 9/1976 | Herbst . | |
| 3,979,918 | 9/1976 | Vidler | 405/261 |
| 4,051,683 | 10/1977 | Koval | 405/261 |
| 4,122,681 | 10/1978 | Vass et al. | 405/261 |
| 4,137,686 | 2/1979 | Kern | 52/737 |
| 4,160,614 | 7/1979 | Koval | 405/259 |
| 4,162,133 | 7/1979 | Clark et al. | 405/258 |
| 4,192,631 | 3/1980 | Vass | 405/261 |
| 4,229,501 | 10/1980 | Kern | 428/399 |
| 4,295,761 | 10/1981 | Hansen | 405/261 |
| 4,347,020 | 8/1982 | White et al. | 405/260 |
| 4,413,930 | 11/1983 | Calandra, Jr. | 405/261 |
| 4,419,805 | 12/1983 | Calandra, Jr. | 405/259 X |
| 4,516,885 | 5/1985 | Calandra | 405/261 |
| 4,518,292 | 5/1985 | Calandra, Jr. | 405/261 |
| 4,611,954 | 9/1986 | Cassidy | 405/261 |
| 4,618,291 | 10/1986 | Wright | 405/261 |
| 4,630,971 | 12/1986 | Herbst et al. | 405/260 |
| 4,666,344 | 5/1987 | Seegmiller | 405/259 |
| 4,678,374 | 7/1987 | Calandra | 405/261 |
| 4,704,053 | 11/1987 | Hipkins et al. | 405/261 |

OTHER PUBLICATIONS

"Dywidag Rock Bolts", Dywidag Systems International (publication undated).

"Dywidag Threadbar Rock and Soil Anchors", Dywidag Systems International, (Feb., 1984).

"Dywidag Threadbars" advertisement, Dywidag Systems International, p. CS-32. Applicant believes this advertisement appeared in a construction magazine, but does not know the title of the publication.

"Allthread *Is* Equal!" advertisement, Advanced Construction Enterprises, Inc., p. CS-56. Applicant believes this advertisement also appeared in a construction magazine, but does not know the title of the publication.

*Primary Examiner*—Dennis L. Taylor

*Attorney, Agent, or Firm*—Stanley J. Price, Jr.

[57] ABSTRACT

A mechanical anchor including an expansion shell and an expansion plug positioned in the shell is engaged with the end of a bar having helically extending rib segments formed on the outer surface of the bar. The expansion plug has an internal bore defining a wall having a configuration to receive and mate with the helically extending rib segments formed on the outer surface of the bar. The mechanical anchor and a portion of the bar are inserted in a bore hole drilled in a rock formation and, upon rotation of the bar in a preselected direction, the expansion plug nonrotatably moves down the bar to expand the shell into engagement with the bore hole wall. As the shell engages the bore hole wall, the bar is mechanically anchored within the bore hole by the mechanical anchor. If it is desired to combine mechanical and chemical anchoring of the bar within the bore hole, the expansion plug is provided with a displaceable stop means positioned in the expansion plug bore, and a curable, two component bonding material is positioned in the bore hole ahead of the mechanical anchor. The stop means permits initial rotation of the mechanical anchor and ribbed bar within the bore hole to mix the bonding material components before the expansion shell is expanded. In addition, various other embodiments of a bar having helically extending rib segments formed on the outer surface of the bar and anchored in a bore hole are disclosed herein.

13 Claims, 3 Drawing Sheets

ROOF BOLT SYSTEM

BACKGROUND OF THE INVENTION

1. Field of the Invention

This invention relates to a method and apparatus for anchoring a ribbed bar in a rock formation, and more particularly, to a method and apparatus for anchoring a ribbed bar in a bore hole by means of a chemical anchor, a mechanical anchor, or a combination chemical and mechanical anchor.

2. Description of the Prior Art

It is well known in the art of mine roof support to tension bolts anchored in bore holes drilled in a mine roof to reinforce the unsupported rock formation above the roof. Conventionally, a hole is drilled through the roof into the rock formation. The end of the bolt is positioned in the rock formation and anchored by either engagement of an expansion shell assembly on the end of the bolt with the rock formation or adhesively bonding the bolt by a resin mixture to the rock formation surrounding the bore hole. The resin mixture penetrates into the surrounding rock formation to adhesively unite the rock strata and to firmly hold the bolt in position in the bore hole. The resin mixture fills the annulus between the bore hole wall and the bolt along a substantial length of the bolt. With the expansion shell assembly it is also known to chamfer the end of the bolt so that the threads on the end of the bolt that receive the expansion shell assembly terminate at a point spaced from the chamfered end of the bolt. This arrangement facilitates dislodging of a stop means positioned within the expansion shell assembly.

U.S. Pat. No. 3,702,060 discloses an expansion shell assembly that includes a resin container which is fixed to the end of an expander positioned within an expansion shell. The container is ruptured after the shell begins to expand. Rotation of the bolt mixes the resin components, and the resin mixture surrounds the shell to embed the shell in the cured resin to bond the shell to the rock strata. When the resin is fully cured, a nut on the end of the bolt opposite a roof plate on the bolt is rotated to bring the roof plate to its fully seated position against the mine roof to fully tension the bolt.

U.S. Pat. No. 3,979,918 discloses a chemical anchor rock bolt and a method of installing an anchor bolt in a bore hole. The rock bolt is provided with a clamping member or nut which is threadedly engaged to the end of the bolt extending beneath the mine roof. The nut is crimped or pressed to remain in fixed engagement with the threaded end of the bolt during mixing of a chemical anchor resin positioned in the bore hole. Upon setting of the resin and on application of an increased driving torque to the nut, the nut is tightened on the rock bolt as required.

Combining bolt tensioning and resin bonding of a mine roof bolt in a bore hole is disclosed in U.S. Pat. No. 4,051,683. The device disclosed in this patent utilizes an internally threaded coupling which is connected at one end to a rebar anchored within the bore hole by the mixed and cured resin. A bolt connected to the other end of the coupling includes a bearing or roof plate advanced into abutting relation with the mine roof. A stop means provided in the coupling limits axial advancement of the bolt into the coupling to prevent relative rotation of the coupling and the bolt as the assembly is rotated to break the resin cartridge and mix the resin components. When the resin cures the rebar above the coupling is adhesively bonded to the rock formation. Thereafter rotation of the bolt in the coupling fractures the stop means to permit the bolt to move upwardly in the bore hole so that sufficient torque is applied to the bolt to tension the bolt.

Similar devices which utilize a rod anchored within the drill hole by resin bonding and connected to a bolt by a coupling are disclosed in U.S. Pat. Nos. 4,122,681 and 4,192,631. The coupling disclosed in U.S. Pat. No. 4,122,681 has an internally threaded bore in which a portion of the threads are deformed to permit initial rotation of both the rod and the bolt within the bore hole. These devices rely upon the bonding of the elongated rod to the rock formation by the resin mixture. They do not utilize a mechanical anchor.

U.S. Pat. Nos. 4,160,614 and 4,162,133 disclose a mechanical anchor in combination with resin bonding of a bolt in a rock formation. Rotation of the bolt with the mechanical anchor attached to the end thereof in a first direction effects mixing of the resin components of a ruptured cartridge. An anti-rotation device prevents relative rotation between the camming plug and the bolt so that the plug is not threaded off the end of the bolt during mixing of the resin components. With this arrangement the resin components are thoroughly mixed before the shell is expanded. After a period of time sufficient to allow mixing of the resin and before the resin hardens, the direction of rotation of the bolt is reversed to disengage the anti-rotation device. The camming plug is then free to advance downwardly on the bolt and expand the shell into gripping engagement with the wall of the bore hole.

U.S. Pat. No. 4,295,761 discloses an elongated anchor which is inserted in a bore hole after insertion of a breakable adhesive resin or grout containing cartridge. The anchor has a threaded end to be received in the threaded portion of a roof nut. The roof nut includes a frangible disc positioned in the threaded portion which is held in place by crimped lip portions. The frangible disc forms a stop wall to stop rotation of the nut relative to the anchor when the nut and anchor are assembled at a first relative axial position. When the anchor is restrained against rotation in the bore hole by setting of the adhesive resin and a torque above a selected threshold is applied to the nut, the crimping is dilated and the disc is expelled to accommodate further threaded insertion of the nut onto the anchor.

U.S. Pat. No. 4,347,020 discloses a mine roof bolt assembly including a shank having anchoring means at one end for securing the shank in the top of a bore hole. The opposite end of the shank is threaded. A bolt head having a central bore and a first threaded bore portion threadedly engages with the threaded end of the shank. A stop plug is threaded into a second threaded bore portion in the bolt head and abuts an end of the shank to initially limit penetration of the shank into the bore of the bolt head. The bolt head is rotated by rotating means having a predetermined torque limit, thereby moving the bolt head longitudinally with respect to the shank and exerting a force on the stop plug. The stop plug strips the threads from the second threaded bore portion, thereby permitting uninterrupted passage of the shank through the bore.

U.S. Pat. Nos. 4,413,930 and 4,419,805 disclose a mechanical anchor including an expansion shell and a camming plug positioned in the shell and threaded onto the end of a mine roof bolt. The mechanical anchor is inserted in a bore hole drilled in a rock formation with a bonding material advanced by upward movement of the bolt to the top of the bore hole. A stop means associated with the mechanical anchor prevents movement of the camming plug on the bolt as the bolt is rotated to effect mixing of the bonding material. The stop means is displaced from the mechanical anchor when the mixed bonding material exerts a force resisting rotation of the camming plug with the bolt, allowing the camming plug to move downwardly on the bolt to expand the expansion shell fingers in the bore hole to anchor the bolt.

U.S. Pat. Nos. 4,516,885 and 4,518,292 disclose a bolt assembly for securing a bolt in a bore hole having bonding material therein including an expansion shell and a camming plug positioned in the shell and threaded onto the end of a mine roof bolt. The expansion shell fingers are arranged to expand outwardly to engage the bore hole wall by longitudinal movement of the camming plug relative to the threaded end of the bolt and the expansion shell. Means is provided for mixing at least a portion of the bonding material upon rotation of the bolt in a preselected direction while maintaining the expansion shell fingers in an unexpanded condition. Means is also provided for moving the camming plug axially on the threaded end of the bolt and relative to the expansion shell fingers as the bolt is rotated in the same preselected direction to expand the expansion shell fingers and anchor the bolt in the bore hole.

U.S. Pat. No. 4,611,954 discloses an apparatus and method for anchoring a bolt in a bore hole including a tensioning plug and expandable sheath assembly threadedly engaged to the end of an elongated bolt. A ring is affixed to the inner wall of the plug adjacent the plug's threaded portion. The end of the bolt abuts the ring upon assembly, thereby causing the bolt and assembly to rotate together upon application of a torque to the bolt. This rotation effects mixing of bonding material placed in the bore hole ahead of the assembly. As the mixed bonding material begins to harden, rotation of the assembly is resisted, and the bolt deforms the ring by cutting threads therein. Continued rotation of the bolt causes the plug to travel axially along the bolt so as to expand the sheath extensions into contact with the bore hole wall.

U.S. Pat. No. 4,666,344 discloses a truss system and components thereof to support rock formations in underground mines, caverns, storage vaults and so forth. The truss brackets utilized in the truss system are designed so that a minimum or no force is exhibited when the tie rods connected between associated truss brackets are tightened down. The various truss brackets are maintained in abutting relation with the mine roof by rock bolts secured in place by a conventional resin anchor. The tie rods and rock bolts each have widely spaced continuous threads to receive a locking nut. The locking nuts are utilized to secure the various truss brackets to the rock bolts and to tension tie rods connected between associated truss brackets.

While it has been suggested by the prior art roof bolt systems to anchor a roof bolt in a bore hole by a combination of resin bonding and mechanical anchoring, the roof bolts presently utilized require a threaded end portion which must be machined onto the end of the standard roof bolt before installation. Threading the end of a roof bolt is a costly and time consuming process. Since the end of the roof bolt must be threaded before installation, roof bolts having a predetermined, fixed length must be threaded at a location distant from the mining operation, and thereafter shipped to the mine for use. Where a rebar is used as a part of the roof bolt system, preparing the ends of the rebar is an even more expensive and time consuming process. To provide a rebar with a threaded end portion, the rebar end portion must first be swaged and thereafter threads machined on the swaged end portion.

As an improvement over the presently available roof bolt systems, this invention discloses a method and apparatus for anchoring a ribbed bar in a bore hole by means of either a chemical anchor, a mechanical anchor, or a combination of chemical and mechanical anchoring. The ribbed bar utilized in this invention does not require threading before the ribbed bar can be used in a roof bolt system.

As is known in the art, rolled bars are commercially available which have a helically extending partial thread roll-formed on the bar outer surface. The extreme difficulty of roll-forming a complete thread on the outer surface of a bar utilizing presently available hot or cold rolled forming processes is well known. However, the technology is presently available for roll-forming a partial thread on the outer surface of a bar or rod. U.S. Pat. No. 3,561,185 discloses a ribbed bar having helically extending rib segments disposed on opposite sides of the circumference of the bar wherein the rib segments extend to their full height over approximately one-third of the circumference of the bar and the end surfaces of each rib segment merge with the outer surface of the bar. Since each bar is rolled to form a partial thread on the bar outer surface, bars positioned end to end may be connected by a coupling having internal threads which mate with the helically extending rib segments formed on the ribbed bars. The suggested use for this ribbed bar is as an anchor member for prestressing concrete.

Bars having partial threads roll-formed on their outer surface have also been used in mining applications as roof supports. For example, in locations within a mine where it is desired to remove a portion of a mine roof, bore holes are drilled through the portion of mine roof to be removed into the strata above. A conventional resin material is inserted in the bore hole ahead of a first ribbed bar, and the first ribbed bar is advanced upwardly into the bore hole. A second ribbed bar is secured to the first ribbed bar by means of a threaded coupling and advanced upwardly in the bore hole until the first ribbed bar is positioned in the bore hole above the portion of the mine roof to be removed. Both bars are then rotated within the bore hole to mix the resin material and chemically anchor the first ribbed bar in the bore hole. Before the portion of the mine roof is removed, the second ribbed bar is removed from the coupling, leaving the first ribbed bar chemically anchored in the bore hole above the portion of the mine roof to be removed.

U.S. Pat. No. 4,630,971 discloses an anchoring apparatus for insertion into a bore hole which includes a tension member in the form of an axially elongated steel rod with force transmission ribs on its outer surface and an anchoring element, such as a nut, engageable with the rod. The anchoring element has an inside surface with inwardly extending projections and the adjacent flanks on the projections form grooves within which the force transmission ribs engage. The anchoring element is formed of a higher strength material than the rod. When a predetermined axially extending tension force acting on the rod is exceeded, relative movement takes place between the anchoring element and the rod. The flanks on the projections on the anchoring element in contact with the ribs on the rod shear off a portion of the ribs contacted. The shearing action affords a sliding anchoring effect between the rod and the anchoring element.

Therefore, there is a need for an improved roof bolt system which utilizes an elongated ribbed bar or rod having helically extending rib segments roll-formed on the outer surface of the bar to provide a partial thread. The helically extending rib segments roll-formed on the outer surface of the bar provide a partial thread and eliminate the need for machine threading the end of the bar as with a conventional roof bolt. Furthermore, since the helically extending rib segments formed on the outer surface of the bar provide a partial thread over the entire length of the bar, ribbed bars may be provided which can be cut to length in the mine to suit particular application requirements. The ribbed bar must be capable of being utilized with a mechanical anchor including an expansion shell and an expansion plug having an internal bore defining a wall threaded to mate with the helically extending rib segments on the outer surface of the bar. Where combined mechanical and chemical anchoring of the ribbed bar in the bore hole is desired, the expansion plug includes a stop means positioned in the expansion plug bore to allow the ribbed bar and mechanical anchor to be rotated initially as a unit within a bore hole. The mechanical anchor and ribbed bar assembly must be capable of being inserted in a bore hole along with a suitable resin bonding material to provide a roof bolt system wherein combined resin bonding and mechanical anchoring of the ribbed bar in a rock formation is effected by continuous rotation of the ribbed bar in a single rotational direction to carry out both the operations of mixing the resin and expanding the shell. Where desired, the mechanical anchor and ribbed bar assembly must be capable of being inserted in the bore hole without resin bonding material to provide straight mechanical anchoring of the ribbed bar in the rock formation by continuous rotation of the ribbed bar in a single rotational direction to expand the shell into engagement with the bore hole wall. When straight mechanical anchoring of the ribbed bar in the bore hole is desired, a mechanical anchor is provided which does not utilize a stop means positioned within the expansion plug bore.

SUMMARY OF THE INVENTION

In accordance with the present invention, there is provided apparatus for anchoring a bar in a bore hole drilled in a rock formation that includes an elongated bar having helically extending rib segments formed on the outer surface of the bar. An expansion plug is provided which has an outer wall surface and an internal bore defining a wall having a configuration to receive and mate with the helically extending rib segments formed on the outer surface of the bar. An expansion shell is also provided having a base portion and a plurality of longitudinal fingers extending from the base portion. The base portion has an opening therethrough for receiving a portion of the ribbed bar. The plurality of longitudinal fingers each have an outer surface for engaging the wall of the bore hole and an inner surface, a portion of the expansion plug outer wall surface abutting the plurality of expansion shell fingers inner surfaces. The bar is engaged with the expansion plug, and the expansion shell and expansion plug are inserted in the bore hole. As the bar is rotated, the expansion plug is nonrotatably moved on the bar to expand the fingers and anchor the expansion shell and bar in the bore hole and allow the bar to be placed under tension in the bore hole.

Further in accordance with the present invention there is provided a method for anchoring a bar in a bore hole that includes the steps of providing an elongated bar having helically extending rib segments formed on the outer surface of the bar. An expansion shell having a base portion with an opening therethrough and a plurality of longitudinal fingers extending from the base portion is positioned in abutting relation with an expansion plug having an outer wall such that a portion of each expansion shell finger contacts the outer wall of the expansion plug. The expansion plug has an internal bore defining a wall having a configuration to receive and mate with the helically extending rib segments on the outer surface of the bar. The method includes the further steps of passing a portion of the bar through the opening in the expansion shell base portion so that a portion of the bar is surrounded by the plurality of longitudinal fingers, and engaging the ribbed bar with the expansion plug. The method includes the additional steps of positioning the expansion shell and expansion plug in a bore hole, and rotating the expansion plug and expansion shell in a predetermined direction in the bore hole upon rotation of the bar. Rotating the bar allows the bar to further engage the expansion plug, and the expansion plug nonrotatably moves on the bar to expand the expansion shell fingers to anchor the expansion shell and bar in the bore hole and apply a tension to the bar.

Additionally in accordance with the present invention, there is provided an apparatus for anchoring a bar in a bore hole which includes an elongated bar adapted for use in a bore hole. The bar has helically extending rib segments formed on the outer surface of the bar. The elongated bar has a first end portion positioned in the bore hole and a second end portion. Engaging means secured to the second end portion of the bar is operable to engage with a rotating means to permit rotation of the bar in the bore hole.

Accordingly, the principal object of the present invention is to provide a method and apparatus for securing a bar having helically extending rib segments formed on the outer surface of the bar in a bore hole and placing the bar under tension.

Another object of the present invention is to provide a mechanical anchor for use with a bar having helically extending rib segments on the bar outer surface in which the mechanical anchor includes an expansion shell and an expansion plug with an internal bore defining a wall having a configuration to receive and mate with the helically extending rib segments on the bar outer surface.

These and other objects of the present invention will be more completely disclosed and described in the following specification, the accompanying drawings and the appended claims.

DESCRIPTION OF THE PREFERRED EMBODIMENTS

Figure 1:
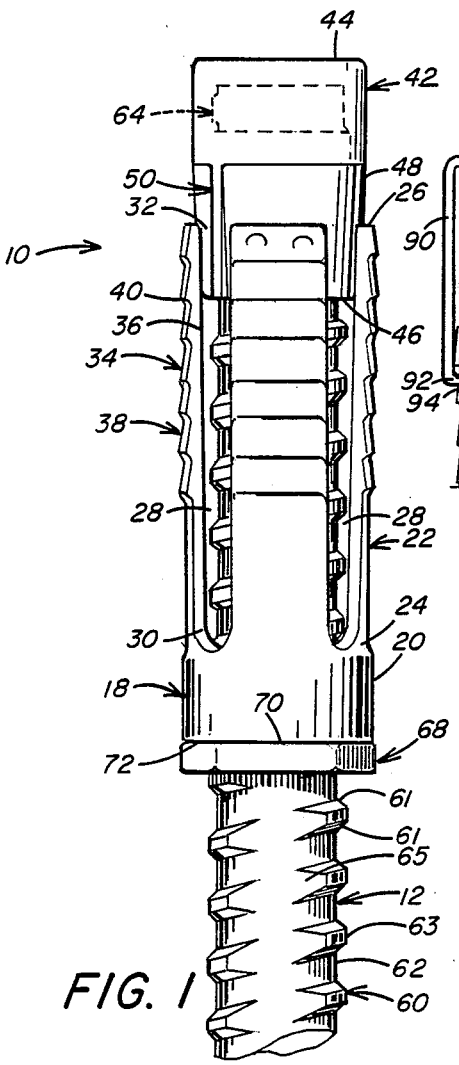
FIG. 1 is a view in side elevation of an expansion shell assembly engaged with the end of a bar having helically extending rib segments formed on the bar outer surface.
Figure 2:
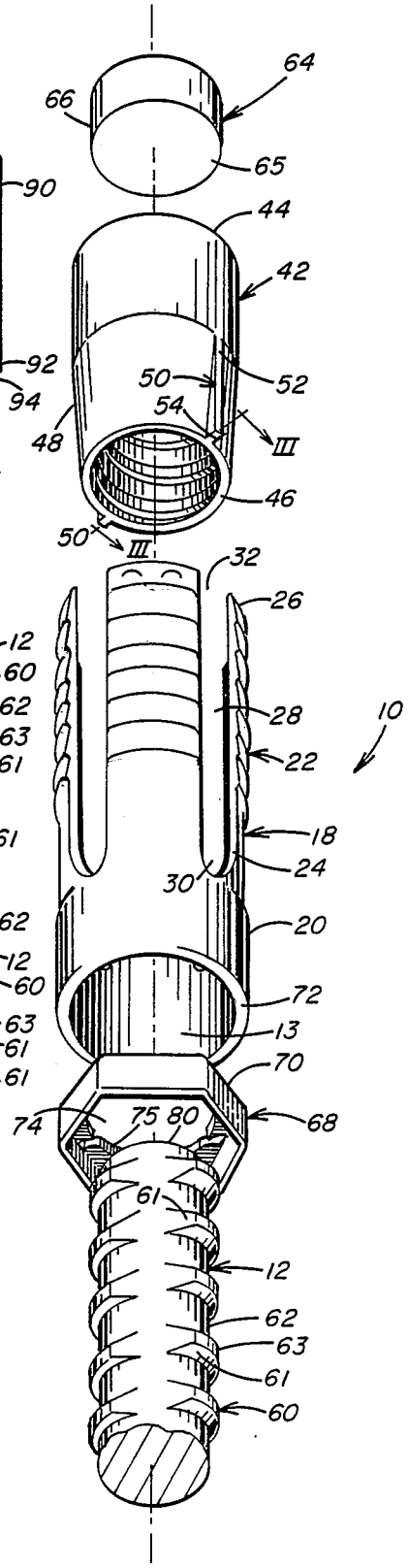
FIG. 2 is an exploded view of the expansion shell assembly and bar illustrated in FIG. 1.

Referring to the drawings and particularly to FIGS. 1 and 2, there is illustrated an expansion shell assembly generally designated by the numeral 10 for securing a ribbed bar or rod 12 in a bore hole 14 drilled in a rock formation 16 (illustrated in FIGS. 4–5) to support the rock formation 16 that overlies an underground excavation, a mine passageway or the like. The bore hole 14 is drilled a preselected depth into the rock formation 16 as determined by the load bearing properties to be provided by the expansion shell assembly 10 and the ribbed bar 12.

The expansion shell assembly generally designated by the numeral 10 includes an expansion shell 18 of conventional design and including a solid ring end portion 20. The expansion shell 18 is expandable and has a plurality of longitudinally extending fingers 22 that extend axially from the ring end portion 20. Each of the fingers 22 has a lower end portion 24 connected to the ring end portion 20 and an upper end portion 26. Longitudinal slots 28 divide the fingers 22 from each other. Each of the slots 28 has a closed end portion 30 adjacent the ring end portion 20 and an open end portion 32 adjacent the upper end portion 26 of the respective fingers 22.

Each finger 22 includes an outer gripping surface 34 and an inner smooth surface 36. The outer surface 34 includes a gripping portion 38 that extends from the finger upper end portion 26 to a position spaced from the finger lower end portion 24. The gripping portion 38 of each finger 22 includes a series of spaced parallel, tapered horizontal grooves 40. The grooves 40 form a series of downwardly extending serrations that are operable upon expansion of expansion shell 18 to engage the wall of the bore hole 14 (FIGS. 4–5) as the fingers 22 bend outwardly.

Figure 5:
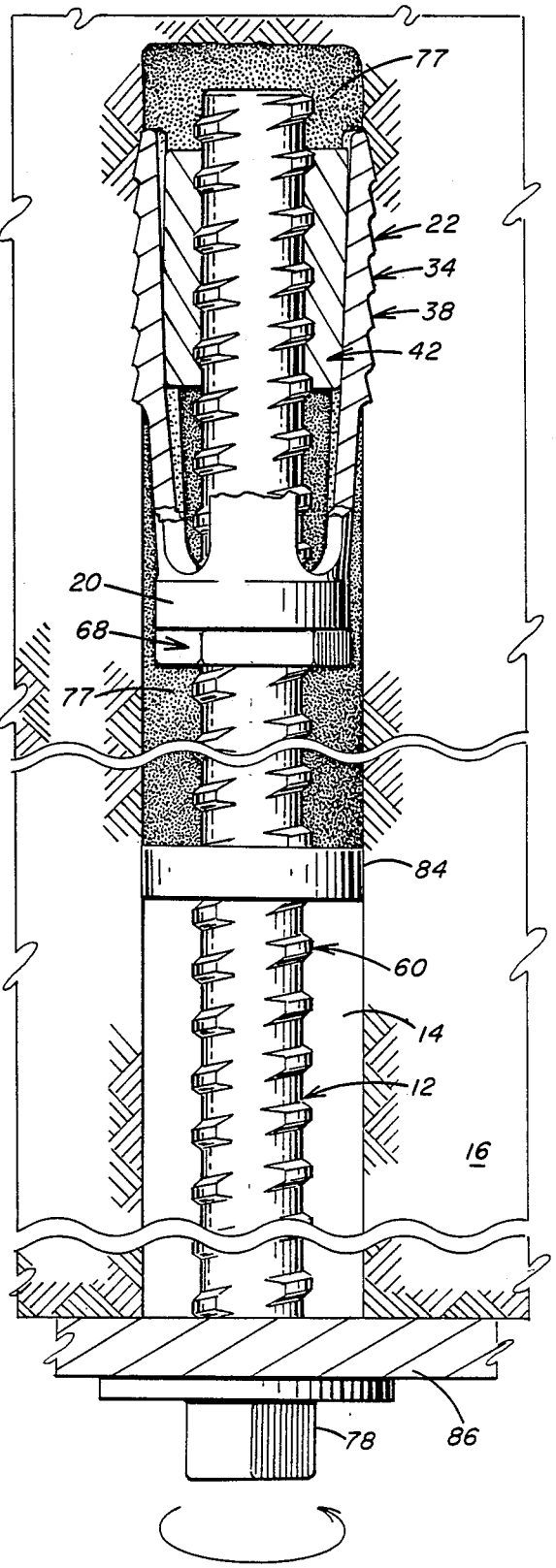
FIG. 5 is a view similar to FIG. 4, illustrating the expansion plug advanced downwardly on the bar after the stop means has been displaced from the expansion plug to fully expand the expansion shell fingers into engagement with the wall of a bore hole with the cured and hardened resin surrounding and embedding the expansion shell.

The gripping portion 38 of each finger 22 is urged into contact with the wall of the bore hole 14, as seen in FIG. 5, by an expansion plug or wedge generally designated by the numeral 42.

Figure 3:
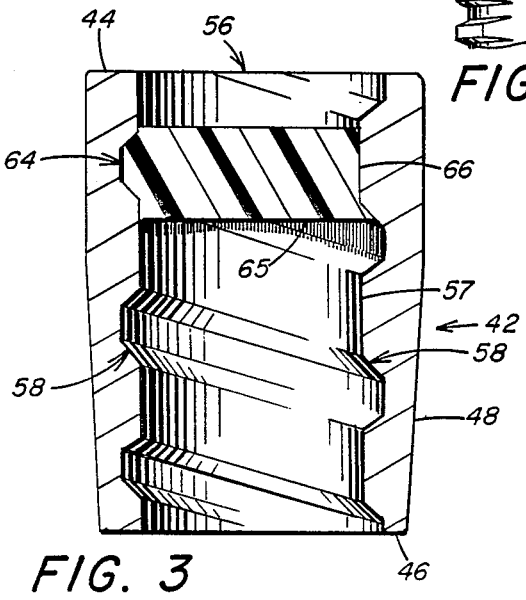
FIG. 3 is a sectional view in side elevation taken along line 3—3 in FIG. 2, illustrating the rear half of an expansion plug internal bore defining a wall which is threaded to mate with the helically extending rib segments formed on the outer surface of the bar and a frangible stop means positioned within the internal bore for abutting the end of the bar.

The expansion plug or wedge generally designated by the numeral 42 is further illustrated in FIGS. 1–3. Expansion plug 42 has a first end portion 44 and a second end portion 46. A generally tapered outer wall 48 extends between first end portion 44 and second end portion 46. A pair of longitudinal protrusions 50 are formed on expansion plug 42 outer wall 48. Each of the longitudinal protrusions 50 has a first end portion 52 positioned a preselected distance from expansion plug first end portion 44 and a second end portion 54 aligned with expansion plug second end portion 46. As seen in FIG. 1, expansion plug 42 is positioned within expansion shell 18 longitudinal fingers 22 so that longitudinal protrusions 50 are positioned within longitudinal slots 28 between pairs of adjacent fingers 22.

Expansion plug 42 has a bore 56 which extends longitudinally through expansion plug 42 from first end portion 44 to second end portion 46. As seen in FIG. 3, which is a sectional view illustrating the rear half of expansion plug 42, expansion plug 42 bore 56 defines a wall 57 having a threaded portion 58. As will be described later in greater detail, threaded portion 58 extends from first end portion 44 to second end portion 46 and has a configuration to mate with the helically extending rib segments 60 formed on the outer surface 62 of ribbed bar 12.

Expansion plug 42 includes a stop means in the form of a frangible plug generally designated by the numeral 64. As will be explained later in greater detail, although frangible plug 64 is illustrated herein, any suitable stop means may be utilized without departing from this invention. As seen in FIG. 3, frangible plug 64 has a preselected thickness and a circular edge portion 66. The stop means or frangible plug 64 is positioned in bore 56 so that circular edge portion 66 of plug 64 engages threaded portion 58. In this manner, frangible plug 64 is maintained in fixed position within threaded portion 58. It should be understood that frangible plug 64 circular edge portion 66 is shown in FIG. 2 for illustrative purposes only. As seen in FIG. 3, the circular edge portion 66 of frangible plug 64 has a configuration which conforms to the configuration of threaded portion 58. As will be explained later in greater detail, frangible plug 64 is formed within bore 56 by a resin or plastic injection mold process known in the art. As a result, the edge portion 66 of frangible plug 64 conforms to the configuration of threaded portion 58.

Frangible plug 64 is positioned within bore 56 a preselected distance from expansion plug 42 second end portion 46 to allow first end portion 80 (FIG. 2) of ribbed bar 12 to threadedly engage threaded portion 58.

Preferably, frangible plug 64 is positioned within bore 56 adjacent first end portion 44 to allow ribbed bar 12 to be threaded into bore 56 threaded portion 58 to a sufficient depth to provide a secure threaded engagement between expansion plug 42 and ribbed bar 12.

The material from which frangible plug 64 is formed is selective, and can be formed from a plastic material such as an epoxy resin or other suitable material. In addition, it should be understood that although frangible plug 64 is illustrated and described herein as the stop means, other types of stop means formed from various metallic materials may also be utilized. The material from which plug 64 is formed is selected to permit plug 64 to be displaced from threaded portion 58 when plug 64 is subjected to predetermined forces. As will be explained later in greater detail, the type of material comprising frangible plug 64, as well as the thickness of frangible plug 64 are selected to control the plug's resistance to displacement based on the torque required to rotate expansion shell assembly 10 and ribbed bar 12 within bore hole 14.

Referring to FIGS. 1 and 2, ribbed bar or rod 12 includes a plurality of rib segments 60 which extend from ribbed bar 12 outer surface 62. The outwardly extending ribs 60 are located along a helically extending line around the longitudinal axis of bar 12 to form a partial thread on bar 12 extending outwardly from outer surface 62. The configuration of rib segments 60 formed on bar 12 is known in the art, as illustrated in U.S. Pat. No. 3,561,185. The plurality of helically extending rib segments 60 are formed on bar 12 by a conventional hot rolling process also known in the art. The plurality of rib segments 60 are disposed on opposite sides of the circumference of the bar 12, and each rib segment 60 has a pair of flanks 61 and a rib top surface 63. Each rib segment 60 extends to its full height only over approximately one-third of the circumference of bar 12, and the end surfaces 65 of each rib segment 60 merge with outer surface 62 of the bar 12. Although each rib 60 extends to its full height over only approximately one-third of the circumference of bar 12, the helically extending rib segments 60 provide a sufficient thread pattern to allow bar 12 to be threaded into bore 56 of expansion plug 42 to be retained within expansion plug 42 threaded portion 58.

Figure 10:
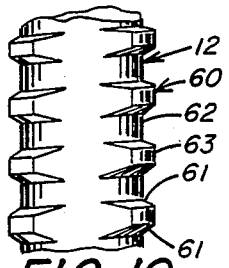
FIG. 10 is a view in side elevation of a portion of a bar for use in a bore hole, illustrating an alternative segment configuration formed on the outer surface of the bar.
Figure 11:
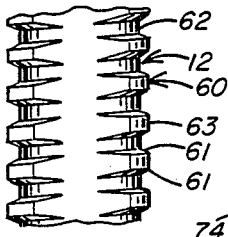
FIG. 11 is a view in side elevation of a portion of a bar for use in a bore hole, illustrating another alternative segment configuration formed on the outer surface of the bar.

As an alternative to the configuration of the rib segments 60 on bar 12 illustrated in FIG. 1, it is believed that, if desired, helically extending ribs 60 may be roll-formed on the outer surface 62 of bar 12 as illustrated in FIGS. 10 and 11. As seen in FIG. 10, each of the helical rib segments 60 which extend from outer surface 62 also have a pair of flanks 61 and a top surface 63. However, a comparison of the rib segments 60 of FIG. 1 and the rib segments 60 of FIG. 10 illustrates that the angular spacing between each of the rib flanks 61 and outer surface 62 illustrated in FIG. 10 is less than the angular spacing between each of the rib flanks 61 and outer surface 62 illustrated in FIG. 1. It is believed that the angular spacing between rib flanks 61 and outer surface 62 may be varied as desired to vary the longitudinal cross sectional configuration of each of the helically extending rib segments 60. As the angle between each of the flanks 61 and outer surface 62 approaches 90°, the longitudinal cross-sectional configuration of each rib 60 will approach a rectangular configuration. As seen in FIG. 11, the pitch of the helically extending ribs 60 may also be varied, if desired, to increase the number of rib segments 60 per inch roll-formed on outer surface 62. It should be understood that if either the cross-sectional configuration or pitch of the helically extending rib segments 60 is varied, the configuration of threaded portion 58 must also be varied to permit threaded engagement of ribbed bar 12 into expansion shell 42.

As seen in FIGS. 1 and 2, the expansion plug 42 and the expansion shell 18 are maintained in assembled relation on ribbed bar 12 prior to inserting the assembly in bore hole 14 drilled in the mine roof by a retaining nut 68. Ribbed bar 12 passes through opening 13 in ring end portion 20 of expansion shell 18 and is threadedly engaged with expansion plug 42. Opening 13 in ring end portion 20 has a diameter larger than the outside diameter of ribbed bar 12 between rib segments 60 positioned on opposite sides of the circumference of bar 12 to allow ribbed bar 12 to pass easily through expansion shell 18. In order to maintain expansion shell 18 and expansion plug 42 in assembled relation, retaining nut 68 is threadedly advanced on the helically extended rib segments 60 of ribbed bar 12 until retaining nut 68 top surface 70 abuts ring end portion 20 bottom surface 72. Retaining nut 68 has a bore 74 with a bore inner wall 75 to threadedly engage the helically extended rib segments 60 on ribbed bar 12. Retaining nut 68 is threadedly advanced on ribbed bar 12 until its top surface 70 abuts ring end portion 20 bottom surface 72 thereby preventing axial movement of expansion shell 18 on ribbed bar 12.

Figure 6:
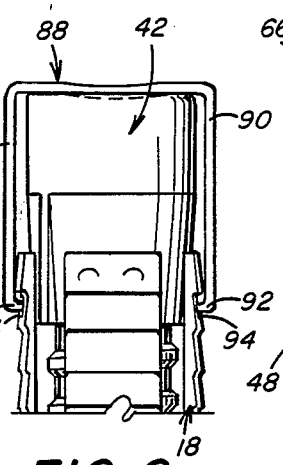
FIG. 6 is a view in side elevation of an expansion plug maintained in abutting relation with an expansion shell by means of a bail assembly.

Expansion plug 42 and expansion shell 18 may also be maintained in assembled relation on ribbed bar 12 prior to inserting the assembly in bore hole 14 by means of a yieldable strap or bail 88, as illustrated in FIG. 6. The bail 88 is conventional and extends across the top of expansion plug 42. The bail 88 includes leg portions 90 that extend downwardly on opposite sides of expansion shell 18. The leg portions 90 terminate in inturned end portions 92 that extend into slots 94 and into engagement with the inner surface 36 of expansion shell 18. With this arrangement, the bail 88 is engaged to the expansion shell 18 to maintain the expansion plug 42 assembled within expansion shell 18.

Although not specifically illustrated in FIGS. 1–3, it should be understood that, prior to installation of expansion shell assembly 10 and ribbed bar 12 in bore hole 14, the first end portion 80 of ribbed bar 12 is passed through opening 13 in expansion shell 18 base portion 20 and threadedly advanced into bore 56 threaded portion 58. Ribbed bar 12 is threadedly advanced into threaded portion 58 until first end portion 80 abuts frangible plug 64 bottom surface 65. After ribbed bar 12 is threadedly advanced into expansion plug 42 bore 56 a sufficient distance to cause first end portion 80 to abut frangible plug 64 bottom surface 65, retaining nut 68 is threadedly advanced on ribbed bar 12 until retaining nut 68 top surface 70 abuts bottom surface 72 of expansion shell 18 base portion 20. In this manner, expansion shell assembly 10 and ribbed bar 12 are assembled as a unit for insertion in bore hole 14 illustrated in FIG. 4.

Figure 4:
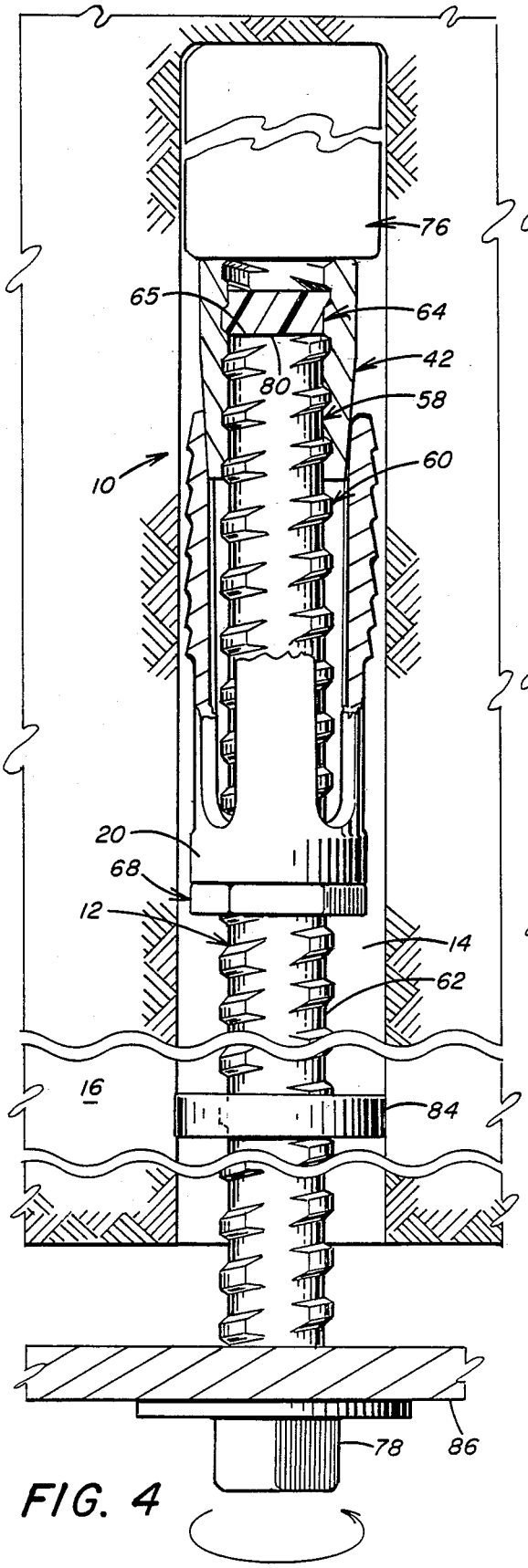
FIG. 4 is a partial fragmentary view in side elevation of an expansion plug and an expansion shell engaged with the end of a bar and positioned in a bore hole beneath a mixable resin cartridge.

Referring to FIG. 4, there is illustrated the expansion shell assembly 10 and ribbed bar 12 previously described. As seen in FIG. 4, a breakable cartridge 76 containing a conventional two-component bonding material is initially inserted in the bore hole 14 and advanced to the top end of the bore hole 14 by upward advancement of the expansion shell assembly 10 and ribbed bar 12 in the bore hole 14. Although not specifically illustrated in FIG. 4, after the cartridge 76 is advanced to the top end of bore hole 14, ribbed bar 12 is thrust upwardly to rupture the cartridge 76. The expansion shell assembly 10 and ribbed bar 12 are thereafter rotated in a preselected direction as indicated by the arrow in FIG. 4 by apply a torque to forged headed end portion 78 of ribbed bar 12. The frangible plug 64 abuts first end portion 80 of ribbed bar 12 and prevents relative rotation between expansion plug 42 and ribbed bar 12 during the initial rotation of the ribbed bar 12 to mix the resin components released from resin cartridge 76. As described, the expansion plug 42 is restrained from moving downwardly on the helically extending rib segments 60 of ribbed bar 12 due to first end portion 80 of ribbed bar 12 abutting plug 64 during the initial rotation of ribbed bar 12 within bore hole 14.

It should be understood that although frangible plug 64 is illustrated and described herein as the stop means, any suitable stop means may be utilized without departing from this invention. For example, a metallic plug or pin may be utilized, or a portion of threaded portion 58 may be deformed to prevent initial axial movement of expansion plug 42 on ribbed bar 12 as expansion shell assembly 10 and ribbed bar 12 are rotated in bore hole 14. It is apparent that any device capable of preventing initial axial movement of expansion shell 42 on ribbed bar 12 as expansion shell assembly 10 and ribbed bar 12 are rotated in bore hole 14 to mix the resin components released from cartridge 76 may be utilized without departing from this invention.

Rotation of the ribbed bar 12 and expansion shell assembly 10 effects mixing of the resin components which are released from cartridge 76 when cartridge 76 is ruptured. Preferably, the components within cartridge 76 include a resin component and a catalyst component. As the ribbed bar 12 and expansion shell assembly 10 are rotated in the bore hole, the resin is mixed with the catalyst to form a catalyst-resin mixture. The mixture, by virtue of its thixotropic characteristics, is retained within bore hole 14. To effectively retain the volume of the mixture in surrounding relation with the expansion shell assembly 10, a suitable device such as washer 84 is utilized. The washer 84 has a diameter sufficient to permit the washer to move freely in the bore hole 14 with ribbed bar 12 into position. In one embodiment the washer 84 is fabricated of metal and is welded on the ribbed bar 12 and spaced a preselected distance below ribbed bar 12 first end portion 80. In another embodiment, the washer 84 is fabricated of an elastomeric material. The elastomeric washer 84 is retained in gripping engagement on the ribbed bar 12 outer surface 62 a preselected distance below ribbed bar 12 first end portion 80.

As seen in FIG. 4, the ribbed bar 12 is rotated continuously in the direction indicated by the arrow to effect mixing of the resin and the catalyst. As previously described, the stop means 64 in the form of a frangible plug abutting first end portion 80 of ribbed bar 12 prevents relative rotation between expansion plug 42 and ribbed bar 12. This prevents the expansion plug 42 from moving downwardly on the ribbed bar 12 until the mixing of the resin components is complete. Although not specifically illustrated in FIG. 4, it should be understood that, during the mixing stage, the ribbed bar 12 is held in position within bore hole 14 with a roof plate 86 abutting rock formation 16 around the open end of the bore hole 14. The thickness and specific composition of plug 64 are chosen to provide that, during the resin and catalyst mixing stage, frangible plug 64 is maintained within bore 56 threaded portion 58 to allow rotation of ribbed bar 12 and expansion shell assembly 10 as a unit within bore hole 14.

As described, frangible plug 64 restrains downward movement of expansion plug 42 on the helically extending rib segments 60 of ribbed bar 12 to insure complete mixing of the resin components before the plurality of fingers 22 of expansion shell 18 are expanded. However, due to the displacement characteristics of the plug 64 designed for the resin system utilized, plug 64 is displaced and the expansion shell 18 fingers 22 expand before the resin mixture completely hardens around the expansion shell 18. From the time cartridge 76 is ruptured, the ribbed bar 12 is continuously rotated in one direction only to mix the resin and catalyst as well as expand the fingers 22 of expansion shell 18. As the ribbed bar 12 is rotated, the curable resin mixture flows into fissures and faults of the rock formation 16 surrounding the bore hole 14. In this manner, the rock strata are adhesively united to further reinforce the rock formation.

As the resin mixture begins to cure or harden in the bore hole 14, it exerts forces on the rotating expansion shell 18 and expansion plug 42 resisting their rotation. When the resistance to displacement of the frangible plug 64 is exceeded by the anti-rotational forces exerted by the resin-catalyst mixture, the frangible plug 64 is displaced from threaded portion 58 by the rotating first end portion 80 of ribbed bar 12. After plug 64 is displaced, expansion plug 42 is free to move downwardly on the partial threads formed by helically extending rib segments 60 and expand the fingers 22 of expansion shell 18 into contact with the wall of bore hole 14.

As seen in FIG. 5, the downward movement of expansion plug 42 on ribbed bar 12 upon continued rotation of ribbed bar 12 expands the fingers 22 of expansion shell 18. The fingers 22 are bent outwardly from ring end portion 20 to move the outer gripping surfaces 34 of fingers 22 into gripping engagement with the wall of bore hole 14. Rotation of ribbed bar 12 is continued until a preselected torque is applied to the ribbed bar 12. When the preselected torque is applied, the expansion shell 18 is fully expanded and the gripping portions 38 of the fingers 22 are embedded in the rock formation 16 to securely anchor the ribbed bar 12 in bore hole 14.

As seen, by anchoring the ribbed bar 12 in bore hole 14 by expansion shell 18 fingers 22, the ribbed bar 12 is tensioned. The cured resin 77 which surrounds the ribbed bar 12 and the expansion shell 18 prevents slippage of the expansion shell 18 in the bore hole 14. The cured resin 77 prevents slippage of the expansion shell 18 within bore hole 14 to provide a relatively constant tension on ribbed bar 12, and also prevents bleed-off between ribbed bar 12 and expansion shell assembly 10.

It should be understood that although a specific rotational direction is illustrated by the arrows in FIGS. 4 and 5, the ribbed bar 12 and expansion shell assembly 10 may either be rotated clockwise or counter-clockwise within bore hole 14 depending upon whether the helically extending rib segments 60 on ribbed bar 12 and the threaded portion 58 of expansion plug 42 are right or left hand thread. Either clockwise or counter-clockwise rotation of ribbed bar 12 and expansion shell assembly 10 will effect proper mixing of the resin components.

As described herein, a bar subjected to a hot roll forming process to form helically extending rib segments on the outer surface of the bar may be threadedly secured to an expansion shell assembly and mechanically and chemically anchored within a bore hole. The use of a bar having helically extending rib segments formed on the outer surface of the bar eliminates the need to thread the end of a roof bolt, or swage and thread the end of a rebar used as a roof bolt. Since the helically extending rib segments on the bar are formed from a hot rolling process, and expansion plugs may be cast with internal mating threads, a roof bolt assembly may be provided which is less expensive to manufacture than roof bolt systems presently available and performs in a manner equivalent to presently available roof bolt systems.

As previously described, expansion plug 42 illustrated in FIGS. 1–5 includes a frangible plug 64 positioned in bore 56 threaded portion 58 to permit initial rotation of expansion shell assembly 10 and ribbed bar 12 within bore hole 14 to provide resin and catalyst mixing. It should be understood, however, that if straight mechanical anchoring of ribbed bar 12 in bore hole 14 is desired, an expansion shell assembly 10 is provided which does not include frangible plug 64 positioned in expansion plug 42 threaded portion 58. If straight mechanical anchoring is desired, first end portion 80 of ribbed bar 12 is threaded into expansion plug 42 threaded portion 58 to a depth sufficient to provide secure threaded engagement between ribbed bar 12 and expansion plug 42. Thereafter, ribbed bar 12 is inserted in bore hole 14 and rotated to permit expansion plug 42 to move on the helically extending rib segments 60 of ribbed bar 12 and urge longitudinal fingers 22 into engagement with the wall of bore hole 14.

Figure 7:
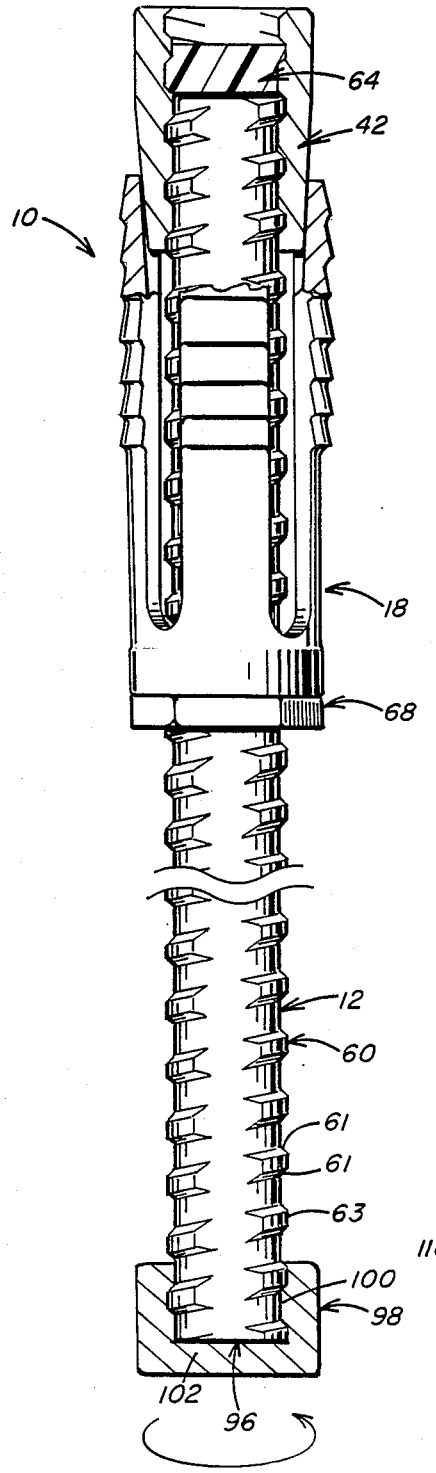
FIG. 7 is a view similar to FIG. 1, illustrating an expansion shell assembly engaged with the first end of a bar having helically extending rib segments formed on the outer surface of the bar, and a cap nut illustrated in section engaged with the second end of the bar to provide a means for rotating the bar and expansion shell assembly within a bore hole.

Referring to FIG. 7, there is illustrated the expansion shell assembly 10 and ribbed bar 12 previously described. As seen in FIG. 7, the ribbed bar 12 has a second end portion 96 opposite first end portion 80 (illustrated in FIG. 3). A cap nut 98 having an internal threaded portion 100 is threadedly advanced on the helically extending rib segments 60 of ribbed bar 12 until cap nut 98 bottom wall 102 abuts second end portion 96 of ribbed bar 12. As described, cap nut 98 may be used to replace ribbed bar 12 forged headed end portion 78 illustrated in FIGS. 4 and 5. Cap nut 98 is threadedly advanced on the end portion 96 of ribbed bar 12 to provide a means for attaching a suitable rotating tool to ribbed bar 12 to rotate ribbed bar 12 within a bore hole drilled in a mine roof for purposes previously described.

Figure 8:
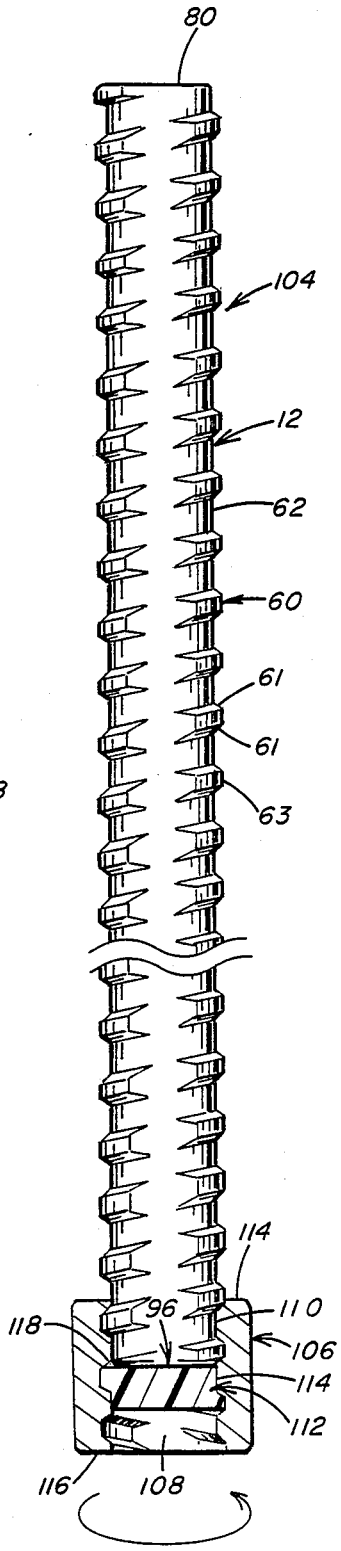
FIG. 8 is a view in side elevation of a bar for use in a bore hole and a tensioning nut having a stop means positioned within the tensioning nut bore engaged to the second end of the bar.

Referring to FIG. 8, there is illustrated another embodiment of a roof bolt which may be chemically anchored in a bore hole to support a rock formation that overlies an underground excavation, a mine passageway or the like. As seen in FIG. 8, roof bolt 104 includes the ribbed bar 12 previously described and a tensioning nut 106 threadedly secured to second end portion 96 of ribbed bar 12.

Tensioning nut 106 has an internal bore 108 which is threaded to mate with the helically extending rib segments 60 formed on the outer surface 62 of ribbed bar 12. The threaded portion 110 of bore 108 includes a frangible plug 112 formed from the same material as frangible plug 64 previously described. As seen in FIG. 8, frangible plug 112 is formed within bore 108 so that plug 112 edge surface 114 is retained within threaded portion 110 to maintain frangible plug 112 in a fixed position within bore 108.

Tensioning nut 106 includes a top surface 114 and a bottom surface 116. Preferably, frangible plug 112 is positioned within bore 108 adjacent bottom surface 116 to allow ribbed bar 12 to be threaded into bore 108 threaded portion 110 to a sufficient depth to provide a secure threaded engagement between ribbed bar 12 and tensioning nut 106.

Prior to insertion of ribbed bar 12 in a bore hole drilled in a mine roof, tensioning nut 106 is threadedly advanced on ribbed bar 12 until second end portion 96 of ribbed bar 12 abuts frangible plug 112 top surface 118. Thereafter, a suitable number of the resin and catalyst-containing cartridges previously described are inserted in the bore hole and ribbed bar 12 is advanced upwardly in the bore hole until first end portion 80 of ribbed bar 12 breaks the resin cartridges to release the resin and catalyst components. The continuous rotation of ribbed bar 12 in the direction indicated by the arrow in FIG. 8 causes a mixing of the resin and catalyst to form a curable resin mixture. As the ribbed bar 12 is rotated, the curable resin mixture flows into fissures and faults of the rock formation surrounding the bore hole to adhesively unite the rock strata and further reinforce the rock formation. In addition, the curable resin mixture flows between adjacent helically extending rib segments 60 on ribbed bar 12.

During the mixing stage, the frangible plug 112 positioned within bore 108 of tensioning nut 106 prevents further advancement of tensioning nut 106 on ribbed bar 12. As the resin mixture begins to cure or harden, ribbed bar 12 is retained within the bore hole by the hardening resin mixture. After the resin mixture completely cures or hardens within the bore hole, a torque in excess of a preselected torque is applied to tensioning nut 106 to allow second end portion 96 of ribbed bar 12 to displace frangible plug 112 from tensioning nut 106 bore 108. Tensioning nut 106 is thereafter threadedly advanced on the ribbed bar 12 helically extending rib segments 60 to place ribbed bar 12 under tension within the bore hole.

Although not specifically illustrated in FIG. 8, it should be understood that a roof plate such as roof plate 86 illustrated in FIGS. 4 and 5 is utilized in conjunction with roof bolt 104. The roof plate provides a suitable abutting surface for tensioning nut 106 top surface 114 to allow roof bolt 104 to be tensioned within the bore hole as tensioning nut 106 is threadedly advanced on ribbed bar 12 in a direction towards ribbed bar 12 first end portion 80.

Figure 9:
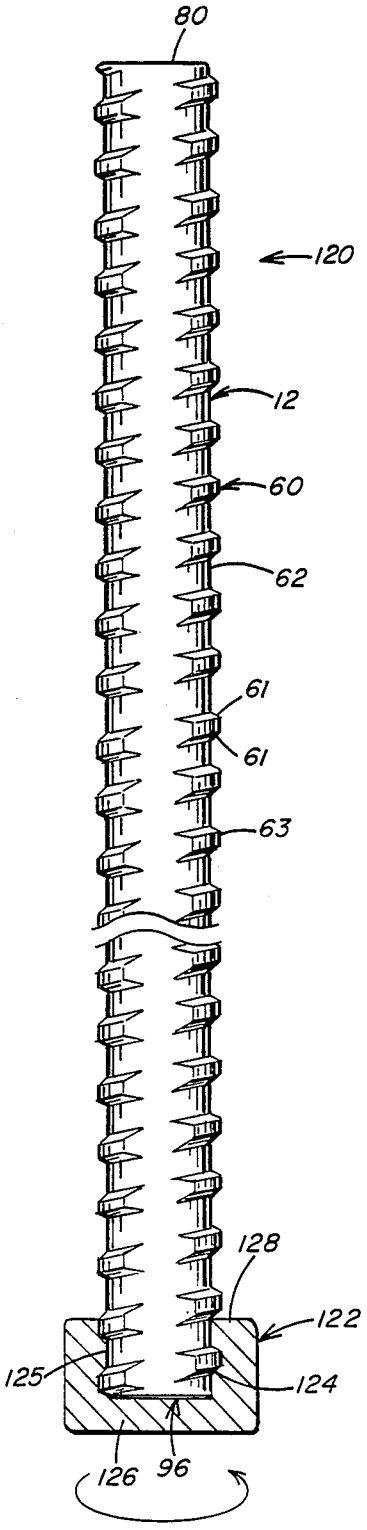
FIG. 9 is a view in side elevation of a bar for use in a bore hole and a cap nut illustrated in section engaged to the second end of the bar.

Referring to FIG. 9, there is illustrated still another embodiment of a roof bolt which may be chemically anchored in a bore hole to support a rock formation that overlies an underground excavation, a mine passageway or the like. As seen in FIG. 9, roof bolt 120 includes the ribbed bar 12 previously described and a cap nut 122 threadedly secured to second end portion 96 of ribbed bar 12.

Cap nut 122 has an internally threaded bore 124 defining a wall 125 which is threaded to mate with the helically extending rib segments 60 formed on the outer surface 62 of ribbed bar 12. As seen in FIG. 9, cap nut 122 is threaded onto ribbed bar 12 until bottom wall 126 of cap nut 122 abuts second end portion 96 of ribbed bar 12.

Ribbed bar 12 is adapted to be inserted in a bore hole and resin anchored within the bore hole over the entire length of the bore hole. A suitable number of the resin and catalyst-containing cartridges previously described are placed in the bore hole, and roof bolt 120 is thrust upwardly into the bore hole to rupture the cartridges and release the resin and catalyst. After the cartridges are ruptured, roof bolt 120 is rotated within the bore hole by a suitable rotating device which is attached to cap nut 122. As roof bolt 120 is rotated, the resin and catalyst are mixed within the bore hole to form a curable resin mixture. As the resin mixture hardens around the helically extending rib segments 60 on ribbed bar 12, the resin mixture maintains ribbed bar 12 in position within the bore hole.

A comparison of FIGS. 7–9 illustrates the versatility of a bar having helically extending rib segments on the bar outer surface as a component in a roof bolt system. By securing an expansion shell assembly such as expansion shell assembly 10 to ribbed bar 12 first end portion 80, ribbed bar 12 may be mechanically anchored in a bore hole. If desired, expansion shell assembly 10 may include a stop means 64 to permit ribbed bar 12 to be both mechanically and chemically anchored in a bore hole. By utilizing a tensioning nut such as tensioning nut 106 illustrated in FIG. 8 or a cap nut such as cap nut 122 illustrated in FIG. 9, ribbed bar 12 may be chemically anchored in a bore hole and placed under tension if desired.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. An apparatus for anchoring a ribbed bar in a bore hole comprising, an elongated bar adapted for use in a bore hole, said bar having a plurality of helically extending discontinuous rib segments formed on the outer surface of said bar, said discontinuous rib segments forming a thread on said bar, an expansion plug having first and second end portions and an outer wall surface, said expansion plug having a bore therethrough defining an inner wall extending from said first end portion to said second end portion, said expansion plug inner wall having a continuous helical thread portion to receive and mate with certain of said helically extending discontinuous rib segments formed on said outer surface of said bar, an expansion shell having a base portion and a plurality of longitudinal fingers extending from said base portion, said base portion having an opening therethrough for receiving a portion of said bar, said plurality of fingers each having an outer surface for engaging the wall of said bore hole and an inner surface, a portion of said expansion plug outer wall surface abutting said plurality of fingers inner surfaces, a portion of said bar extending through said opening in said expansion shell base portion and surrounded by said longitudinal fingers, portions of said bar discontinuous rib segments engaging said continuous helical thread portion of said expansion plug, and means for rotating said elongated bar relative to said expansion plug to threadably move said bar discontinuous rib segments in said expansion plug continuous helical thread portion and move said expansion plug on said elongated bar to more rapidly and with fewer revolutions expand said expansion shell fingers and anchor said expansion shell and said bar in said bore hole and apply a tension to said ribbed bar.

2. An apparatus for anchoring a ribbed bar in a bore hole as set forth in claim 1 which includes, a stop means positioned in said expansion plug bore, a portion of said bar extending through said opening in said expansion shell base portion and engaging said expansion plug continuous helical thread portion and abutting said stop means, said stop means preventing longitudinal relative movement between said bar and said expansion plug to permit said bar, said expansion shell and said expansion plug to rotate together within said bore hole upon application of a preselected torque to said bar, and said bar arranged to displace said stop means from said expansion plug bore upon applying to said bar a torque in excess of a preselected torque so that additional discontinuous ribbed segments on said bar further engage said expansion plug and said expansion plug nonrotatably moves on said bar to expand said expansion shell fingers and anchor said expansion shell and said bar in said bore hole and apply a tension to said bar.

3. An apparatus for anchoring a ribbed bar in a bore hole as set forth in claim 1 which includes, bonding material positioned in an unmixed condition in said bore hole ahead of said expansion shell and said expansion plug, said stop means positioned in said expansion plug bore operable to prevent further engagement between said bar and said expansion plug to cause said bar, said expansion shell and said expansion plug to rotate together within said bore hole to mix said bonding material in said bore hole, said stop means arranged to be displaced from said expansion plug bore when said mixed bonding material exerts a force resisting rotation on said expansion shell and said expansion plug, thereby permitting rotation of said bar relative to said expansion plug and said expansion shell, and said expansion plug being nonrotatably movable on said bar after said stop means is displaced from said expansion plug bore to expand said fingers into engagement with the wall of said bore hole.

4. An apparatus for anchoring a ribbed bar in a bore hole as set forth in claim 1 in which, said continuous helical thread portion in said expansion plug inner wall extends completely through said expansion plug bore from said first end portion to said second end portion.

5. An apparatus for anchoring a ribbed bar in a bore hole as set forth in claim 1 in which, the depth of the recessed portions between said helical threads in said expansion plug inner wall is greater than the height of each discontinuous rib segment extending from said bar outer surface.

6. An apparatus for anchoring a ribbed bar in a bore hole as set forth in claim 1 in which, each of said discontinuous rib segments includes a pair of flanks each extending from said bar outer surface at substantially the same included angle.

7. A method for anchoring a ribbed bar in a bore hole comprising the steps of, providing an elongated bar having a plurality of helically extending discontinuous rib segments formed on the outer surface of said bar, positioning an expansion shell having a base portion with an opening therethrough and a plurality of longitudinal fingers extending from said base portion in abutting relation with an outer wall of said expansion plug so that a portion of each said finger contacts said expansion plug outer wall, providing said expansion plug with a bore therethrough, said bore defining an inner wall having a continuous helical internal thread to receive and mate with a portion of said helically extending discontinuous rib segments on said bar outer surface, passing a portion of said bar through said opening in said expanion shell base portion, said portion of said bar surrounded by said plurality of longitudinal fingers, engaging a portion of said helically extending rib segments on said bar with said internal threaded portion of said expansion plug, positioning said expansion shell and said expansion plug in a bore hole, rotating said expansion plug and said expansion shell in a predetermined direction in said bore hole upon rotation of said bar, and engaging additional discontinuous segments on said bar to said internal thread of said expansion plug, said expansion plug nonrotatably moving longitudinally on said bar to more rapidly and with fewer revolutions expand said expansion shell fingers and anchor said expansion shell and said bar in said bore hole and apply a tension to said bar.

8. A method for anchoring a ribbed bar in a bore hole as set forth in claim 7 including the further steps of, positioning a stop means in said expansion plug bore, passing a portion of said bar through said expansion shell base portion opening and engaging said expansion plug with said bar until said bar abuts said stop means, said stop means preventing further engagement between said bar and said expansion plug to permit said bar, said expansion shell and said expansion plug to rotate together within said bore hole upon application of a preselected torque to said bar, and displacing said stop means from said expansion plug bore upon applying to said bar a torque in excess of said preselected torque so that said bar further engages said expansion plug and said expansion plug nonrotatably moves on said bar to expand said expansion shell fingers into engagement with a bore hole wall.

9. A method for anchoring a ribbed bar in a bore hole as set forth in claim 7 including the further steps of, positioning a bonding material in an unmixed condition in said bore hole ahead of said expansion shell and said expansion plug, preventing further engagement between said bar and said expansion plug with said stop means, rotating said bar, said expansion shell and said expansion plug as a unit within said bore hole to mix said bonding material, displacing said stop means from said expansion plug bore when said mixed bonding material exerts a force resisting rotation on said expansion shell and said expansion plug, thereby permitting rotation of said bar relative to said expansion plug and said expansion shell, and nonrotatably moving said expansion plug on said bar after said stop means is displaced from said expansion plug bore to expand said fingers into engagement with a bore hole wall.

10. An apparatus for anchoring a ribbed bar in a bore hole comprising, an elongated bar adapted for use in a bore hole, said bar having helically extending discontinuous rib segments formed on the outer surface of said bar, said bar having a first end portion adapted to be positioned in a bore hole and a second end portion, and engaging means having a continuous internal thread, said engaging means threadedly secured to said discontinuous rib segments of said bar at said second end portion operable to engage a rotating means to permit rotation of said bar within said bore hole by said rotating means.

11. An apparatus for anchoring a ribbed bar in a bore hole as set forth in claim 10 which includes, an expansion shell and expansion plug assembly engaged with said elongated bar at said first end portion, said expansion plug having an internal bore defining a wall having a continuous internal thread to receive and mate with a portion of said helically extending discontinuous rib segments formed on said outer surface of said bar.

12. An apparatus for anchoring a ribbed bar in a bore hole as set forth in claim 10 in which said engaging means includes, a tensioning nut engaged with said bar at said second end portion, said tensioning nut having an internal bore defining a wall having a configuration to receive and mate with said helically extending rib segments formed on said outer surface of said bar, and a stop means positioned in said tensioning nut bore to permit rotation of said bar in said bore hole by said rotating means.

13. An apparatus for anchoring a ribbed bar in a bore hole as set forth in claim 10 in which said engaging means includes, a cap nut engaging with said bar at said second end portion, said cap nut having an internal bore extending a preselected distance into said cap nut, said bore defining a wall having a configuration to receive and mate with said helically extending rib segments formed on said outer surface of said bar, said cap nut having outer wall surface adjacent said internal bore to close said bore and thereby limit the amount of engagement of said cap nut on said ribbed bar second end portion.

* * * * *